US006643381B2

(12) United States Patent
Tsai

(10) Patent No.: US 6,643,381 B2
(45) Date of Patent: Nov. 4, 2003

(54) SOUND QUALITY IMPROVING MECHANISM FOR LOUDSPEAKER

(76) Inventor: Jen-Hui Tsai, 3F., No. 3, Lane 67, Ching Shing Road, Wen Shen Suburb, Taipei (TW)

( * ) Notice: Subject to any disclaimer, the term of this patent is extended or adjusted under 35 U.S.C. 154(b) by 36 days.

(21) Appl. No.: 09/950,645

(22) Filed: Sep. 13, 2001

(65) Prior Publication Data

US 2002/0039429 A1 Apr. 4, 2002

(30) Foreign Application Priority Data

Sep. 22, 2000 (TW) ..... 89216448 U

(51) Int. Cl.[7] ..... H04R 25/00
(52) U.S. Cl. ..... 381/433; 381/412
(58) Field of Search ..... 381/354, 345, 381/346, 348, 411–414, 353, 162, 433, 395, 386, 396

(56) References Cited

U.S. PATENT DOCUMENTS 1,743,749 A * 1/1930 Arkell ..... 381/406
3,311,703 A * 3/1967 Grinstead ..... 381/113
3,417,268 A * 12/1968 Lace ..... 381/401
3,766,319 A * 10/1973 Gschwandtner ..... 379/388.02
4,675,907 A * 6/1987 Itagaki et al. ..... 381/152
4,797,935 A * 1/1989 Tanaka ..... 381/392
4,939,783 A * 7/1990 Dunning ..... 381/386
5,566,242 A * 10/1996 Hall ..... 381/423
6,219,431 B1 * 4/2001 Proni ..... 381/397

* cited by examiner

*Primary Examiner*—Curtis Kuntz
*Assistant Examiner*—P. Dabney
(74) *Attorney, Agent, or Firm*—Shoemaker and Mattare

(57) ABSTRACT

A sound quality improving mechanism for a loudspeaker is proposed, in which a hollow annular component is deposited with a vibration-absorbing material therein. A plurality of conductive components are each disposed in a manner as to penetrate the hollow annular component in a diametrical direction, for allowing the hollow annular component to be held in place at a back end of a loudspeaker in a manner that the conductive components abut a peripheral surface of the back end of the loudspeaker, and for conducting vibration at the back end of the loudspeaker in a diametrical direction to the hollow annular component to be absorbed by the vibration-absorbing material, so as to improve the sound quality of the loudspeaker.

17 Claims, 4 Drawing Sheets

SOUND QUALITY IMPROVING MECHANISM FOR LOUDSPEAKER

FIELD OF THE INVENTION

The present invention relates to sound quality improving mechanisms for loudspeakers, and more particularly, to a sound quality improving mechanism for allowing the sound quality of a loudspeaker to be improved by eliminating or inhibiting the vibration in a diametrical direction at a back end of the loudspeaker.

BACKGROUND OF THE INVENTION

FIG. 1 is a sectional view of a conventional speaker system, wherein a loudspeaker 120 mounted at a installing hole 102 of a sound box 100 is a moving-coil type loudspeaker, which generates a sound by utilizing magnetic force between a permanent magnet 122 disposed at a back end of the loudspeaker 120 and a moving coil 123 to effect vibration of a cone 124.

In theory, the cone 124 vibrates only in an axial direction (a left-right direction as shown in the drawing). However, in fact, as the magnetic force is not uniformly distributed between the permanent magnet 122 and the moving coil 123, thus the vibration of the cone 126 has a component in a diametrical direction (an up-down direction as shown in the drawing). Therefore, the loudspeaker 120 has its front end held in place at the installing hole 102, and its back end suspended in the air to generate vibration in a diametrical direction due to the diametrical-direction component of the vibration of the cone 124. The back-end vibration of the loudspeaker 120 not only affects the sound quality of the loud-speaker 120 itself, but also can be conducted to the sound box 100, making vibration and noise generated by the sound box 100. Therefore, it is desired to develop a sound quality improving mechanism for eliminating back-end vibration of a loudspeaker in a diametrical direction so as to improve the sound quality of the loudspeaker.

SUMMARY OF THE INVENTION

A primary objective of the present invention is to provide a sound quality improving mechanism for a loudspeaker, so as to eliminate or inhibit vibration at a back end of the loudspeaker in a diametrical direction.

In accordance with the above and other objectives, the present invention proposes a sound quality improving mechanism for a loudspeaker, comprising: a hollow annular component containing a vibration-absorbing material therein; and a plurality of conductive components each disposed in a manner as to penetrate the hollow annular component in a diametrical direction, for allowing the hollow annular component to be held in place at a back end of a loudspeaker in a manner that the conductive components abut a peripheral surface of the back end of the loudspeaker, and for conducting vibration at the back end of the loudspeaker in a diametrical direction to the hollow annular component to be absorbed by the vibration-absorbing material.

The conductive components are preferably adjustable in position relative to the hollow in the diametrical direction. For example, the hollow annular component can be formed in the diametrical direction with a plurality of threaded holes in number identical to the conductive components, and the conductive components are rotationally screwed to the threaded holes in the diametrical direction, allowing the conductive components to be adjusted in position relative to the hollow annular component in the diametrical direction. Therefore, the sound quality improving mechanism for a loudspeaker of the invention can be firmly held in place at a back end of a loudspeaker, in a multi-point fixation manner as to sleeve the back end of the loudspeaker with the hollow annular component, and tightly screw the conductive components to the threaded holes until the conductive components each having its front end abutting a permanent magnet at the back end of the loudspeaker. Further, as the conductive components can be screwed in or out of the threaded holes to an extent according to back-end diameter of the loudspeaker so as to accommodate the loudspeaker in the hollow annular component, the sound quality improving mechanism for a loudspeaker of the invention is applicable to loudspeakers various in back-end diameters, in the condition of the annular hollow component larger in diameter than a back end of a loudspeaker.

Furthermore, the vibration-absorbing material needs to be able to absorb energy of the back-end vibration of the loudspeaker in the diametrical direction through the conductive components. In this case, the vibration-absorbing material can be a liquid with fluidity or a plurality of solid particles that can be densely packed in the hollow annular component, for example, common lubricating oil, or lead particles with diameter of 0.8 cm, respectively.

In addition, the conductive components are not particularly restricted in number and arrangement, but it is preferable that at least three of the conductive components are arranged at equal angular intervals.

Alternatively, the hollow annular component and the vibration-absorbing material contained therein can be replaced with a solid annular component in heavy weight, wherein the heavy weight of the solid annular component is capable of increasing back-end weight of the loudspeaker, allowing the back-end vibration of the loudspeaker in the diametrical directions be reduced in amplitude or prevented from occurrence. This therefore also helps improve the sound quality of the loudspeaker.

BRIEF DESCRIPTION OF THE DRAWINGS

The present invention can be more fully understood by reading the following detailed description of the preferred embodiments, with reference made to the accompanying drawings, wherein.

DETAILED DESCRIPTION OF THE PREFERRED EMBODIMENT

Figure 1:
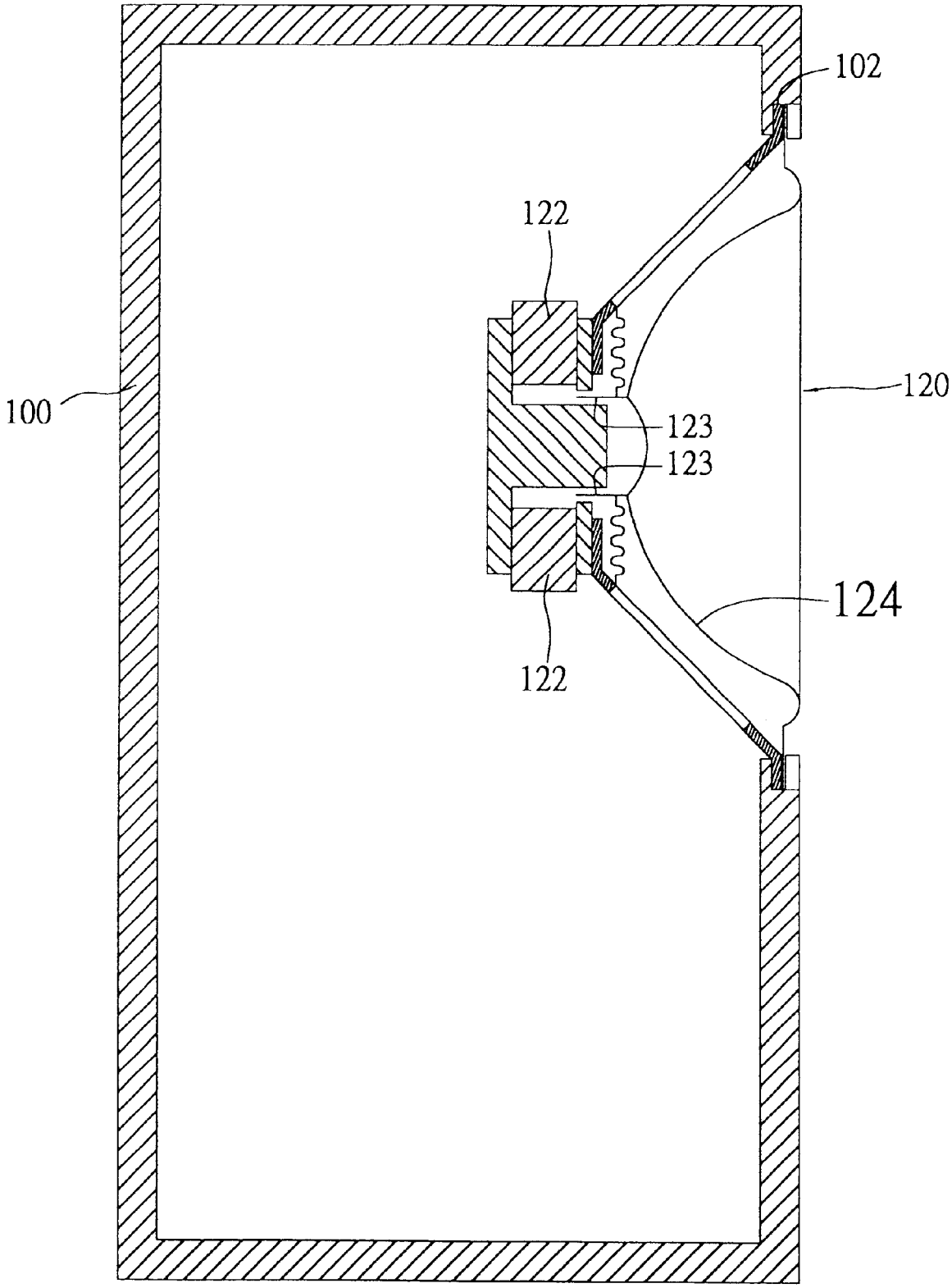
FIG. 1 (PRIOR ART)
FIG. 1 (PRIOR ART) is a sectional view of a conventional speaker system.
Figure 2:
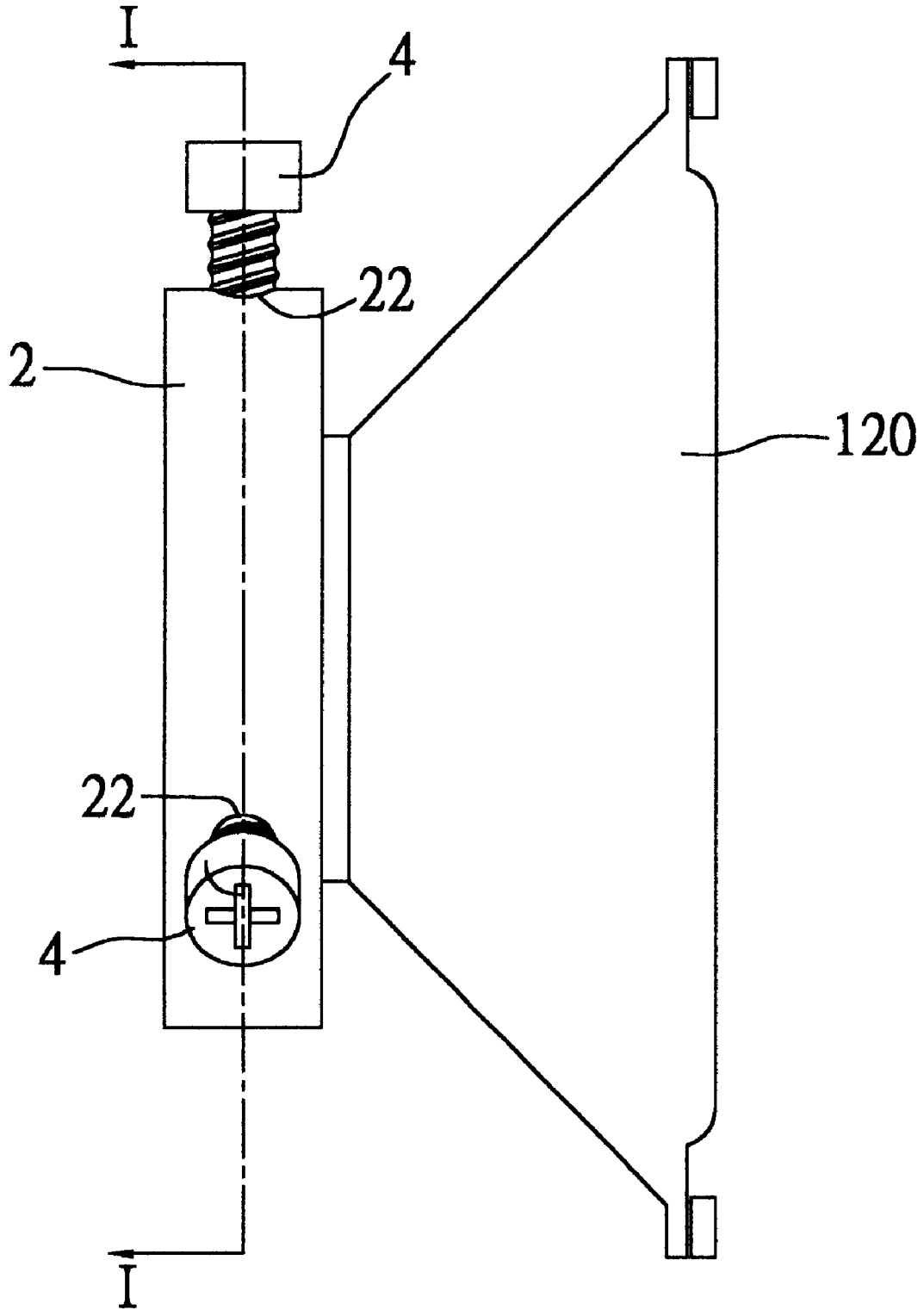
FIG. 2 is a side view of the sound quality improving mechanism for a loudspeaker of the invention installed at a back end of the loudspeaker.
Figure 3:
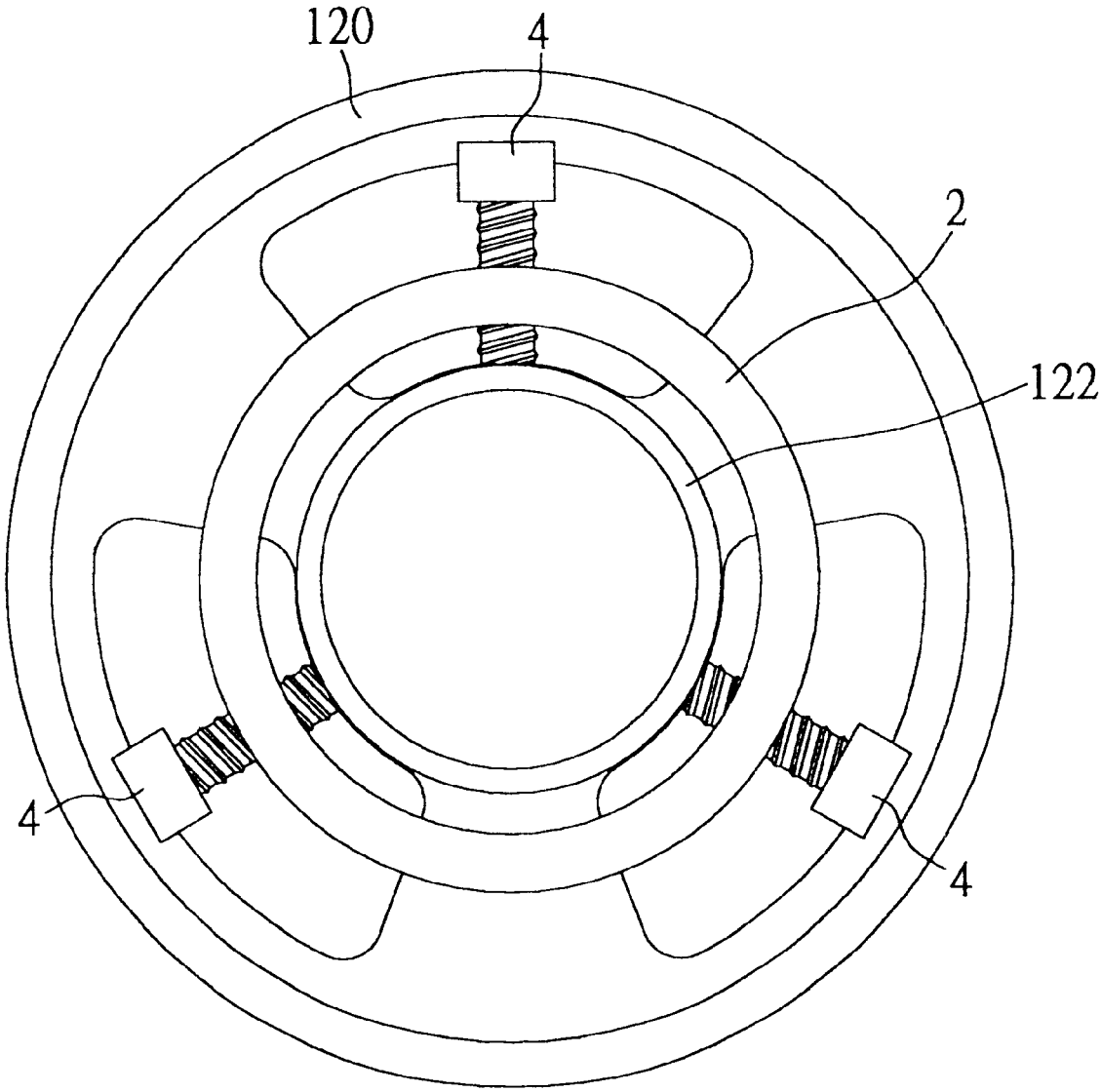
FIG. 3 is a back view of the sound quality improving mechanism for a loudspeaker of the invention.
Figure 4:
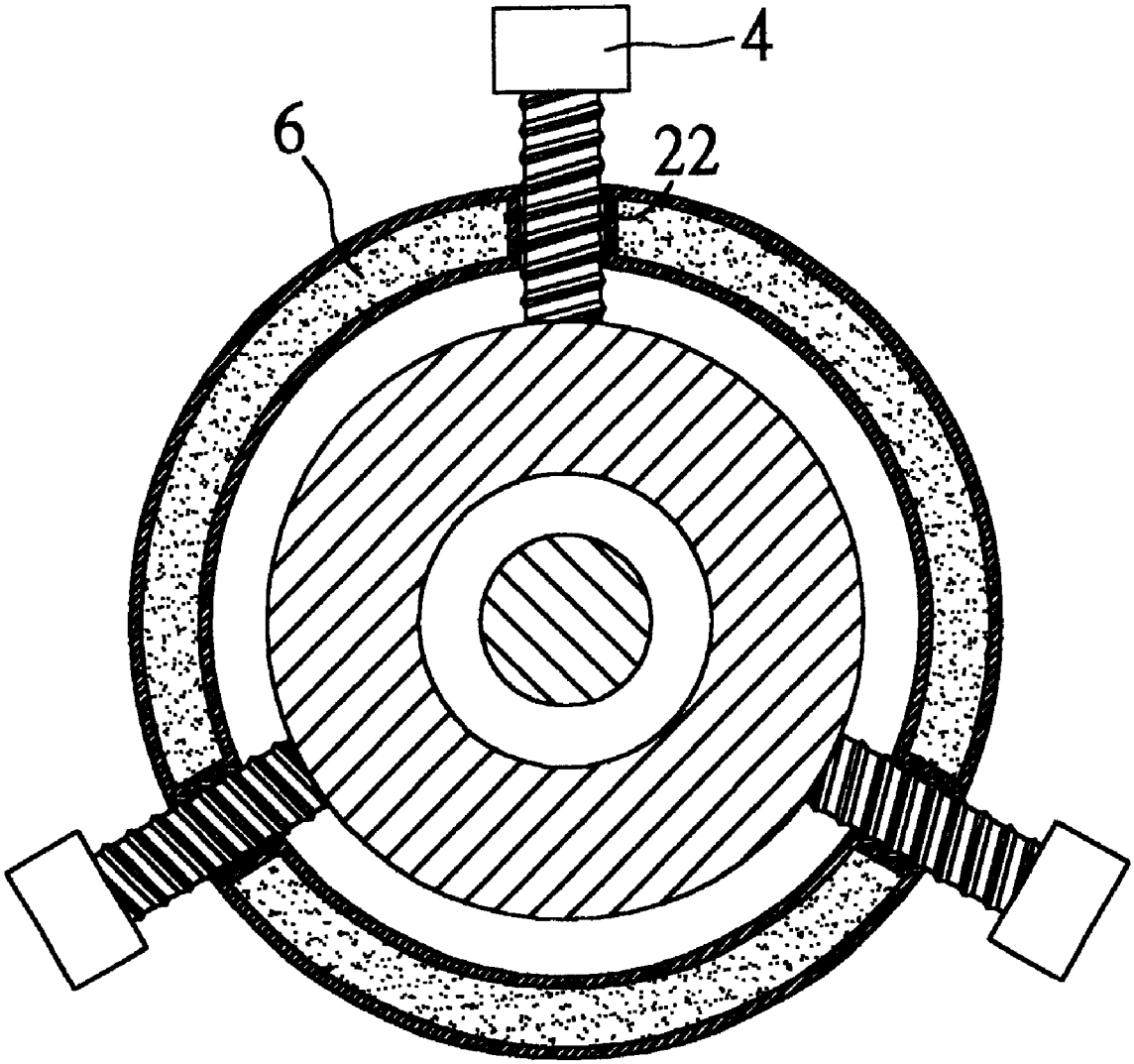
FIG. 4 is a sectional view of FIG. 2 cutting along the I—I sectioning line.

FIG. 2 is a side view of the sound quality improving mechanism for a loudspeaker of the invention installed at a back end of the loudspeaker; FIG. 3 is a back view of the sound quality improving mechanism for a loudspeaker of the invention; FIG. 4 is a sectional view of FIG. 2 cutting along the I—I sectioning line. The sound quality improving mechanism for a loudspeaker of the invention is described with reference to FIGS. 2–4 as follows.

The sound quality improving mechanism for a loudspeaker of the invention mainly comprises a hollow annular component 2 and three conductive components 4 disposed on the hollow annular component 2. The hollow annular component 2 has a cross section in a circular or rectangular shape without any particular limitation. As shown in FIG. 4, in the hollow annular component 2 along its diametrical direction there are formed three threaded holes 22 at equal angular intervals, wherein the threaded holes 22 each penetrates through the hollow annular component 2 in the diametrical direction.

The conductive components 4 each is formed with screw threads such as a screw bolt or screw lever, and has a length greater than that of the threaded hole 22. As shown in FIG. 4, the conductive components 4 are coupled to the threaded holes 22 and can be adjusted in position relative to the hollow annular component 2 in the diametrical direction in a screwing-in or screwing-out manner. Therefore, as shown in FIG. 2 or 3, the sound quality improving mechanism for a loudspeaker of the invention can be firmly held in place at a back end of a loudspeaker 120, in a multi-point fixation manner as to sleeve the back end of the loudspeaker 120 with the hollow annular component 2, and tightly screw the three conductive components 4 to the threaded holes 22 until the conductive components 4 each having its front end abutting a permanent magnet 122 at the back end of the loudspeaker 120.

Furthermore, with respect to a loudspeaker having its back end with a larger diameter, the sound quality improving mechanism of the invention can be fixed on the loudspeaker in the foregoing manner, with the conductive components 4 being screwed out of the threaded holes 22 to an extent for allowing the back end of the loudspeaker to be accommodated in the hollow annular component 2. As such, in the condition of the annular hollow component 2 larger in diameter than a back end of a loudspeaker, the sound quality improving mechanism for a loudspeaker of the invention is applicable to loudspeakers various in back-end diameters.

Besides, as shown in FIG. 4, a liquid or a plurality of solid particles can be packed in the hollow annular component 2 as a vibration-absorbing material 6. This allows back-end vibration in the diametrical direction of the loudspeaker 120 to be conducted through the front ends of the conductive components 4 and the threaded holes 22 to the vibration-absorbing material 6, so that energy of the back-end vibration of the loudspeaker 120 can be absorbed by the vibration-absorbing material 6. The liquid or solid serving as the vibration-absorbing material 6 are preferably, but not limited to, common lubricating oil or lead particles with a particle diameter of 0.8 cm, respectively.

In the above, the conductive components 4 are exemplified to be adjustable in position, however, they are not limited to this restriction. Alternatively, the conductive components 4 can be designed in a manner as to be directly held in place on the hollow annular component 2. In this case, the sound quality improving mechanism of the invention is only applicable to a loudspeaker of a certain size, with the same function in eliminating back-end vibration of the loudspeaker nonetheless.

Moreover, the hollow annular component 2 containing the vibration-absorbing material 6 is exemplified as above. However, a solid annular component in heavy weight can be used, which increases back-end weight of a loudspeaker, and thus reduces amplitude or occurrence of back-end vibration of the loudspeaker in a diametrical direction, so as to achieve the same purpose for improving the sound quality of the loudspeaker. In this case, components such as screw bolts or screw levers formed with screw threads on the solid annular component and adjusted in position relative to the solid annular component at a diametrical direction in a screwing-in or screwing-out manner, are hereby referred to holding components for their only function of holding the solid annular component in place at a back end of the loudspeaker.

In conclusion from the above mentioned, the sound quality improving mechanism of the invention has the following advantages. First, energy of back-end vibration of a loudspeaker in a diametrical direction can be absorbed by a vibration-absorbing material deposited in a hollow annular component, so that the back-end vibration can be eliminated and prevented from being conducted to a sound box to make the sound box vibrate and generate noise; this is highly useful in improving the sound quality of a speaker system. Moreover, as conductive components are screwed to threaded holes in the hollow annular component and can be adjusted in position relative to the hollow annular component in a diametrical direction, this allows the sound quality improving mechanism of the invention to be detachably disposed at the back end of the loudspeaker in a screwing-tight or screwing-loose manner. Further in the condition of the hollow annular component larger in diameter than the back end of the loudspeaker, the sound quality improving mechanism of the invention is applicable to loudspeakers various in back-end diameters. In addition, in the sound quality improving mechanism of the invention, as the hollow annular component having the vibration-absorbing material (or a solid annular component) is significantly heavy in weight, this therefore increase back-end weight of the loudspeaker for allowing the back-end vibration of the loudspeaker in the diametrical direction to be reduced in amplitude or prevented from occurrence. Besides, the increase in weight at the back end of the loudspeaker can also increase the recoil of vibration of a cone in an axial direction, thereby making a sound generated by the vibration of the cone more solid and clear.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A sound quality improving mechanism for a loudspeaker, comprising:

a hollow annular component containing a vibration-absorbing material; and a plurality of conductive components each penetrating the hollow annular component in a diametrical direction, for supporting the hollow annular component at a back end of a loudspeaker in a manner that the conductive components abut a peripheral surface of the back end of the loudspeaker and conduct vibration at the back end of the loudspeaker in a diametrical direction to the hollow annular component to be absorbed by the vibration-absorbing material.

2. The sound quality improving mechanism for a loudspeaker of claim 1, wherein the conductive components are arranged at equal angular intervals.

3. The sound quality improving mechanism for a loudspeaker of claim 1, wherein the conductive components each is adjustable in position relative to the hollow annular component in the diametrical direction.

4. The sound quality improving mechanism for a loudspeakers of claim 3, wherein the hollow annular component is formed in the diametrical direction with a plurality of threaded holes in number identical to the conductive components, and the conductive components are rotationally screwed to the threaded holes in the diametrical direction.

5. The sound quality improving mechanism for a loudspeaker of claim 4, wherein the threaded holes are arranged in the hollow annular component at equal angular intervals.

6. The sound quality improving mechanism for a loudspeaker of claim 1, wherein the vibration-absorbing material is a liquid with fluidity or a plurality of solid particles densely packed in the hollow annular component.

7. The sound quality improving mechanism for a loudspeaker of claim 2, wherein the vibration-absorbing material is a liquid with fluidity or a plurality of solid particles densely packed in the hollow annular component.

8. The sound quality improving mechanism for a loudspeaker of claim 3, wherein the vibration-absorbing material is a liquid with fluidity or a plurality of solid particles densely packed in the hollow annular component.

9. The sound quality improving mechanism for a loudspeaker of claim 4, wherein the vibration-absorbing material is a liquid with fluidity or a plurality of solid particles densely packed in the hollow annular component.

10. The sound quality improving mechanism for a loudspeaker of claim 5, wherein the vibration-absorbing material is a liquid with fluidity or a plurality of solid particles densely packed in the hollow annular component.

11. A sound quality improving mechanism for a loudspeaker, comprising: an annular component of heavy weight having a longitudinal axis and a diametrical direction perpendicular to said axis; and a plurality of holding components each penetrating the annular component in the diametrical direction, for securing the annular component to a back end of a loudspeaker in a manner that the holding components abut a peripheral surface of the back end of the loudspeaker.

12. The sound quality improving mechanism for a loudspeaker of claim 11, wherein the holding components are arranged at equal angular intervals.

13. The sound quality improving mechanism for a loudspeaker of claim 11, wherein the holding components each is adjustable in position relative to the annular component in the diametrical direction.

14. The sound quality improving mechanism for a loudspeaker of claim 13, wherein the annular component is formed in the diametrical direction with a plurality of threaded holes in number identical to the holding components, and the holding components are rotationally screwed to the threaded holes in the diametrical direction.

15. The sound quality improving mechanism for a loudspeaker of claim 14, wherein the threaded holes are arranged in the annular component at equal angular intervals.

16. The sound quality improving mechanism for a loudspeakers of claim 1, wherein the loudspeaker is a moving-coil type speaker.

17. The sound quality improving mechanism for a loudspeakers of claim 11, wherein the loudspeaker is a moving-coil type speaker.

* * * * *